US007337828B2

(12) United States Patent
Lange

(10) Patent No.: US 7,337,828 B2
(45) Date of Patent: Mar. 4, 2008

(54) HEAT TRANSFER USING A HEAT DRIVEN LOOP

(76) Inventor: Jack Lange, 104 Old Mill Road, Winnipeg, Manitoba (CA) R3J 3G9

( * ) Notice: Subject to any disclaimer, the term of this patent is extended or adjusted under 35 U.S.C. 154(b) by 179 days.

(21) Appl. No.: 10/474,774

(22) PCT Filed: Apr. 11, 2002

(86) PCT No.: PCT/CA02/00490

§ 371 (c)(1),
(2), (4) Date: Apr. 15, 2004

(87) PCT Pub. No.: WO02/084195

PCT Pub. Date: Oct. 24, 2002

(65) Prior Publication Data

US 2004/0168685 A1 Sep. 2, 2004

Related U.S. Application Data

(60) Provisional application No. 60/283,150, filed on Apr. 12, 2001.

(51) Int. Cl.
*F24H 9/20* (2006.01)
*F28D 15/00* (2006.01)

(52) U.S. Cl. ..... 165/104.21; 126/344; 126/351.1; 126/361.1; 122/31.1; 203/22; 203/27; 203/DIG. 8

(58) Field of Classification Search ..... 210/774
See application file for complete search history.

(56) References Cited

U.S. PATENT DOCUMENTS 4,216,903 A 8/1980 Giuffre
4,314,601 A 2/1982 Giuffre
4,393,663 A 7/1983 Grunes
5,947,111 A 9/1999 Neulander et al.

(Continued)

FOREIGN PATENT DOCUMENTS

CA 1264443 1/1990

(Continued)

OTHER PUBLICATIONS

Patent Abstract of Japan vo. 1996. No. 4, Apr. 30, 1996 JP 07 324881 Mitsubishi Calbe Ind. Ltd. and translation.

*Primary Examiner*—Robert James Popovics
(74) *Attorney, Agent, or Firm*—Adrian D. Battison; Michael R. Williams; Ryan W. Dupuis

(57) ABSTRACT

A heat transfer fluid medium (25) within the closed system is arranged to boil to form a vapor in the evaporation section (12) and such that release of heat from the condensation section (11) to the fluid to be heated (4A) causes the vapor to condense to liquid in the condensation section (11). The conduit forms a loop (10) and back flow in the loop (10) is prevented by providing a trap (27) of liquid in the conduit at a position adjacent to or at the evaporation section (12). The flow around the loop (10) at high speed sufficient to carry all condensate forwardly is caused solely by application of energy to the system by the heat source (21) without mechanical pumping. Inert gases are collected immediately upstream of the trap (27) and can be purged therefrom.

22 Claims, 9 Drawing Sheets

U.S. PATENT DOCUMENTS

2004/0168685 A1* 9/2004 Lange ..... 126/351.1

FOREIGN PATENT DOCUMENTS

| | | |
|---|---|---|
| CA | 2262990 | 5/2003 |
| DE | 42 08 625 | 9/1993 |
| EP | 0 141 529 | 5/1985 |
| WO | WO/82/03680 | 10/1982 |
| WO | WO 02084195 A1 * | 10/2002 |

* cited by examiner

HEAT TRANSFER USING A HEAT DRIVEN LOOP

This application is a 371 of PCT/CA02/00490, filed Apr. 11, 2002 which claims priority from U.S. Provisional Application Ser. No. 60/283,150 filed Apr. 12, 2001.

This invention relates to a heating system transferring heat from a heat source such as a combustion heating system to a fluid to be heated which is particularly but not exclusively designed for heating oil in storage tanks, oil emulsion treatment tanks and oil upgrading and refining process vessels.

BACKGROUND OF THE INVENTION

Reference is made to Canadian Patent 1,264,443 (Spehar) issued Jan. 16, 1990 and U.S. Pat. No. 5,947,111 (Neulander et al) issued Sep. 7, 1999 to Hudson Products Corp (which corresponds to Canadian application 2,262,990) which describe prior art arrangements and the disclosure of these prior patents is hereby incorporated by reference to show the type of installation and use to which the present device can to be put.

Reference is also made to the prior U.S. Pat. No. 4,393,663 (Grunes) which shows a heat loop arrangement for heating various materials, primarily water, within a container. However this arrangement has not been proposed for and is not suitable for the heating of oil and particularly crude oil in a storage tank

SUMMARY OF THE INVENTION

It is one object of the present invention to provide an improved method of heat transfer from a heat source to a fluid to be heated.

According to the present invention there is provided a method for transferring heat from a heat source to a fluid to be heated comprising:

providing a heat source;

providing a fluid to be heated at a position spaced from the heat source;

providing a closed system including at least one conduit;

providing an evaporation section of the closed system at the heat source;

providing a condensation section of the closed system in the fluid to be heated;

providing a heat transfer fluid medium within the closed system having a temperature of boiling from liquid to vapor such that heat from the heat source causes the liquid to boil to form a vapor in the evaporation section and such that release of heat from the condensation section to the fluid to be heated causes the vapor to condense to liquid in the condensation section;

the at least one conduit forming a loop extending from the evaporation section through the condensation section and back to the evaporation section so as to conduct the heat transfer fluid medium from the evaporation section to the condensation section and back to the evaporation section;

preventing back flow in the loop so that flow in the loop forming the conduit can occur in one direction only by providing a trap of liquid in the conduit at a position adjacent to or at the evaporation section;

and causing a flow in the heat transfer medium around the loop by application of energy to the system by the heat source.

The trap provides a mechanism for prevention back flow which can be designed and arranged to not only prevent back flow, , but also to utilize the adjustability of the trap to provide sufficient back pressure and force of flow to maintain flow of vapor, carry-over liquid from the vaporizer and condensate, substantially in one direction, and drive this combination through resistance imposed by restrictions and deployments, above and below the level of the vaporizer, of the condenser.

The trap also provides a block, for any residue of the inert gases that are used for initial purging plus any inert gases that are generated over a period of time by chemical interaction of the fluid[s] and the materials from which the device is constructed and the accumulation of which will progressively impair the effectiveness of the system, against which these gases will accumulate as swept along by the fluid flow while in operation and unable to pass through the trap, in a location that is accessible from outside the vessel which enables these gases to be detected and purged from the system utilizing the pressure of the system while in operation. Thus the trap is arranged so that it stops the forward flow of the inert gases at the trap and there is provided an access opening which can be opened at the position immediately upstream of the trap so that the gases can be purged, with the system under pressure so that the vapor drives out the inert gases until escape of vapor is detected.

The system is primarily designed for use in heating crude oil in a tank but can also be used for other heating systems including heating air for forced air systems and space heating. The system can also be used for heating oil in a duct of pipe as it flows past the condensation section of the loop.

The system consists of a closed loop, sealed from atmosphere and containing a fluid. The fluid is vaporized in the energy absorbing section by the application of heat. The temperature and pressure of the system vary in a fixed relationship according to the vaporization characteristics of the fluid and the amount of heat applied. The vapor is conducted to the energy emitting section where it condenses, giving off its latent heat. The condensate flows back through the trap to the energy absorbing section. Vapor is driven in one rotational direction by the liquid differential pressure of the condensate gathering trap which self-adjusts to overcome flow resistance through the energy emitting section of the loop. The system has no moving mechanical parts.

The system consists of a single conduit or a multiplicity of such conduits connected by input and output manifolds to the evaporation section at the heat source outside the storage tank or fluid to be heated.

The trap is not only self adjusting but its range of adjustability can be increased or decreased by increasing or decreasing the depth of the trap to permit greater liquid level differentials to offset greater energy emitting section resistance.

The configuration of the loop and trap is such that the energy of the system is sufficient to both overcome the resistance of the energy emitting section but also to sustain a vapor flow velocity sufficient to carry along with it substantially all the condensate produced in the energy emitting section, plus a limited quantity of liquid physically carried out of the energy absorbing section due to boiling action. This is an important feature that should be designed into the configuration in order to assure the conveyance of additives, such as anti-corrosion agents and anti-freezing agents, throughout the loop rather than have them confined to the energy absorption section due to being precipitated due to vaporization or isolated due to selective vaporization. However, and this is important, the system should not carry over liquid from the vaporizer so as to substantially form a conventional bubble pump, such as in a percolator, so that the degree of bubble pump action must be controlled by the design such that it occurs only to the extent necessary to convey the additives and not to the extent that it contributes significantly in the conveyance of heat.

Conveyance of heat substantially totally occurs due to change of state at a fixed temperature rather then by loss of sensible heat from this liquid by a decreasing temperature of the liquid through the energy emitting section. In other words, the bubble pump action must not significantly interfere with the capability of the system to maintain a constant temperature across the heating element when utilized for heating purposes.

The only portions of the system where gravity is the principal force determining condensate flow, or liquid position, is the; trap, any transition from the energy emitting section to the energy absorbing section where condensate flow to the trap may be substantially directed by gravity, and, the portion of the energy absorbing section where liquid is held in direct proximity to the heat source by the configuration of that portion of the system.

Consequently, the heat energy emitting section of the loop can be of any lateral or vertical deployment in relation to the energy absorbing section, and can be of any sizing or other physically restricting configuration and can accommodate whatever other load demands requiring pressure differential that might be placed upon the system, provided all of that is within the capability of the energy absorption section to absorb sufficient heat energy and, the capability of the trap to withstand sufficient back pressure to overcome the resistance imposed by these.

A specific heat emission temperature can be selected by an appropriate choice of a fluid having the desired temperature/pressure relationship and a construction capable of withstanding the pressure associated with that temperature, and can be maintained while in operation by controlling the amount of heat that is absorbed, by controlling fuel flow to the burner. The controller can be actuated by sensing either temperature or pressure of the vapor issuing from the vaporizer, which have a fixed relationship.

In practice, the system is charged with water and additives, purged with an inert gas such as argon, the internal pressure reduced to close to a complete vacuum at normal ambient temperature, the system sealed, and then operated at below a maximum 15 psi. This pressure range is readily tolerated with conventional construction and is below the pressure that would warrant classification as a pressure vessel. In some applications, the system would then remain permanently sealed and initial setting of internal pressure in relation to temperature and the initial charge of fluid would remain for the service life of the device. In other applications, the system in its operational mode would be sealed but provision would be made for the periodic servicing such as; removal of buildup of inert gases due to chemical interactions between fluid[s] and conduit material, replacement of the fluid due to chemical degeneration, and re-establishment of vacuum at normal ambient due to leakage.

However the system can also be operated at higher temperatures and pressures and may use liquids different from water which may have a higher boiling point although water is well known to provide a very high latent heat of vaporization. The available selection of heat transfer fluids is limited only by practicality, and would include for example those shown in the attached Table, the principle considerations and limitations being the vaporization temperature/pressure relationship characteristics of the fluids and the chemical interactivity between the heat transfer fluid and the material utilized to construct the loop. A single or multiplicity of heat transfer liquids can be employed in a given system. In one arrangement, all of the transfer liquids may circulate throughout the system in admixture by vaporization and condensing. Alternatively, one or more of the liquids may act as a 'boiling bed' for others depending on the temperature and pressure range of the system from shutdown to full operation and the vaporization characteristics of the liquids. This is significant because additives may be required for such purposes as inhibiting chemical interaction and preventing freezing.

Because heat transfer is substantially wholly accomplished by change of state, the temperature of the energy emitting section is constant throughout its length and is selectable amongst fluids having appropriate temperature/pressure characteristics and chemical characteristics. Both of these characteristics are highly desirable for processes that are enhanced by selectability and controllability of temperature, such as the different processes involved in petroleum processing, which would include:

[a] Water and particulate matter separation from raw petroleum product which is facilitated by holding the raw product at as uniform and high a temperature as can be sustained below the boiling point of water in order to minimize viscosity which promotes separation and to avoid boiling creating foam which seriously disrupts the process due to interference with heat transfer and other effects. It is an important aspect of this system that not only does the uniform temperature of the heating elements contribute to maintaining a higher average temperature of the raw product just below the boiling point of water, but, at no point on the element is the raw product exposed to localized temperatures above the boiling point of water causing localized vaporization of water and occasioning precipitation and accumulation of particulate matter on the surface of the heating elements which reduces their effectiveness for heat transfer and reduces their service life. This would be in contrast to direct fired immersion tube heaters which feature a large temperature differential over their length and

[b] Upgrading and refining of petroleum product, which are essentially a matter of exposure of crude product to a variety of temperatures which are selectable, controllable, and, as constant as can be achieved over the heat transfer surface for the purpose of producing by distillation various petroleum products which have characteristic vaporization temperatures. The effectiveness of the process, in terms of the purity of product, is enhanced by maintaining the crude product within as narrow a temperature band as possible.

Another important feature of this technology in that it is highly adaptable to optimizing, or maximizing, heat transfer capacity in relation to the internal volume of the system. This is of significance in relation to the regulatory requirements for pressure vessels. Pressure vessels are defined as containers in which pressure is generated as a consequence of applying heat, a classic example being conventional steam boilers. There are two further stipulations to the definition; that the pressure generated be in excess of 15 psi, and that the volume of the vessel be in excess of 65 liters. Anything of less volume, regardless of pressure, is designated as a 'fixture' and is not subject to the requirements for operating a pressure vessel. These requirements are onerous in that they include constant attendance by a certified person and regular inspection. Such requirements may vary in specifics from jurisdiction to jurisdiction but will substantially involve maximum pressures and volumes.

Because the system described herein is capable of operating at a great variety of temperatures and pressures compared to conventional heat transfer systems involving steam or hot water due to the variety of fluids that can be employed having different temperature/pressure characteristics, much higher heating element temperatures can be generated than is common for steam or hot water systems and it is also possible to do so at lower pressures than would be produced with water.

For example, propylene glycol could be utilized which has a vaporization temperature of 605 Degrees F. at 15 psi gauge pressure compared to a vaporization temperature for water of 250 Degrees F. at 15 psi gauge pressure. Thus higher temperatures, and greater heat exchange, can be achieved with propylene glycol than with water at pressures below the limit specified for definition as pressure vessel. Alternatively, at 40 psi gauge pressure, water vaporization temperature increases to 287 Degrees F. while propylene glycol vaporization temperatures rise to 1048 Degrees F. Thus much higher temperatures, and much greater heat exchange can be achieved with vessel volumes below the limit specified for classification as a pressure vessel and therefore classified as a fixture, regardless of pressure.

Hence this system provides two means of enhancing capacity without encroaching upon the definition of a pressure vessel, by the utilization of the higher temperatures associated with higher pressures while maintaining volumes below the maximum for a fixture, and the utilization of fluids that have a temperature/pressure characteristic such that higher temperatures can be maintained at pressures below the maximum for pressures for pressure vessels and therefore unlimited in volume.

This aspect of this technology has particular significance with respect to space and air replacement heating applications. In such systems, self-contained, compact heater modules incorporating higher temperature heat exchangers are an alternate to systems consisting of conventional unit heaters, make-up air heaters, etc., incorporating larger, lower temperature heat exchangers, and connected to a steam boiler via a steam and condensate circulating system.

It is also significant in relation to the amount of material employed in relation to capacity which, in turn, relates to cost of manufacture.

The energy absorption section of the loop may be open to the combustion action or may be encapsulated within an enclosed housing which is filled with a liquid intermediate heating medium. The use of an encapsulation and heating medium allows the heating system to sustain an even, maximum tolerable temperature over the heat absorption surface thus minimizing the amount of surface required and contributing to the minimization of the volume of the system pursuant. In practice, the intermediate heating medium is preferably what is referred to as a thermal oil, capable of maintaining stability at temperatures close to the crystallization temperature of mild steel. The whole heat absorption surface is then covered with that temperature. To the contrary, when directly heated with combustion products, which normally would be of uneven temperature, only the peak temperature could be at that level otherwise the surface would be damaged and the average would be considerably less. Encapsulation also enables more than one heater module to be supplied with heat from one central fuel combustion device by transferring the intermediate heating medium from that device to any number of heater modules.

When used for heating a process liquid within a storage tank, the heating system preferably includes an arrangement in which one or more heating loops are heated externally of the tank and extend into the tank so that heat is transferred from the evaporation area at the heat source to the condensation area within the tank. The evaporation area is located within a vessel, which may contain high temperature heating oil in an encapsulating vessel where the vessel is heated by a burner so that the oil transfers heat to the condensation area of the single heat loop or of each loop if there is more than one.

Also, a multiplicity of condensing sections can be heated from one vaporizer such that more than one tank or more than one space or make-up air heater can be supplied with vapor from one vaporization source. The transition system from the vaporization section to the condensation section[s] may be with rigid or flexible conduit and may be such that the vaporizer can be located at ground or floor level with conduit conveying vapor to condenser[s] located at a higher level within the capability of the system to maintain fluid flow substantially in one direction.

The burner is controlled by thermostats which may be located within the tank so that the temperature of the oil within the tank is maintained within required limits. Alternatively, the temperature or pressure, as these are directly related, within the heat loop may be detected for maintaining the required amount of heat input to keep the temperature and pressure at the operating value.

An over temperature shut off is provided for safety. This may be provided within the loop itself preferably as a pressure sensor. Preferably the shut off is of the resetting type so that combustion is re-started after a predetermined cool down period since this overcomes problems should the over pressure situation causing the shut down to occur be temporary. This is particularly possible where very viscous materials around the heat emission part of the heat loop temporarily reduce or prevent convection currents in the process liquid in the tank causing the emission part to overheat since the viscous materials act as an insulator. Alternatively the over temperature shut off may be located within an encapsulating heating oil so that if the heating oil exceeds a predetermined temperature the burner is shut off. Thus there is no detection of temperature at the surface of the condensation area of the heat loop within the tank.

It is an important feature of this system that it is capable of cycling, fairly rapidly if need be, in response to an on/off condensation section temperature or pressure control, or, be capable of operating at reduced firing rates in response to a modulating condenser temperature or pressure control, during the start-up phase due to delays in establishing full heat exchange capacity from the condenser s at full firing capacity because of thermal and flow characteristics of the process fluid being heated. Establishing generalized convection circulation in vessels filled with raw petroleum products can be problematical during the heating startup phase due to high viscosities, the effect of low temperature exposure on viscosities, variations in water content particularly as that is trapped next to heating elements, and, tendency of product to establish and accelerate flow along channels of least resistance rather than establish overall convection currents.

Reliable, stable operation during this initial startup period when demand for product temperature is at its maximum but tolerance of heat absorption is at its minimum is a major advantage of the arrangement described herein over the Grunes et al technology which requires stable operation above a minimum level of heat input over a minimum period of time to establish and maintain a liquid block at the 'resistor' in order to operate with the flow of vapor and liquid in one direction.

The heat loop is not a heat pipe of any form and does not use surface tension to pump the liquid back to the heated area. Instead the heat loop is a generally conduit with two generally upwardly extending legs and two generally transverse arms forming a loop. A trap is formed at the evaporation area at the bottom of one leg so that vapor is prevented from flowing up the leg at the evaporation area and thus the vapor is driven upwardly along the leg at the evaporation area and transversely along the top arm from the heat source outside the tank transversely into the body of the tank.

BRIEF DESCRIPTION OF THE DRAWINGS

Embodiments of the invention are described herein in conduction with the attached drawings as follows.

Table A attached hereto shows a list of possible fluids for use in the system as heat transfer medium.

DETAILED DESCRIPTION

Figure 1:
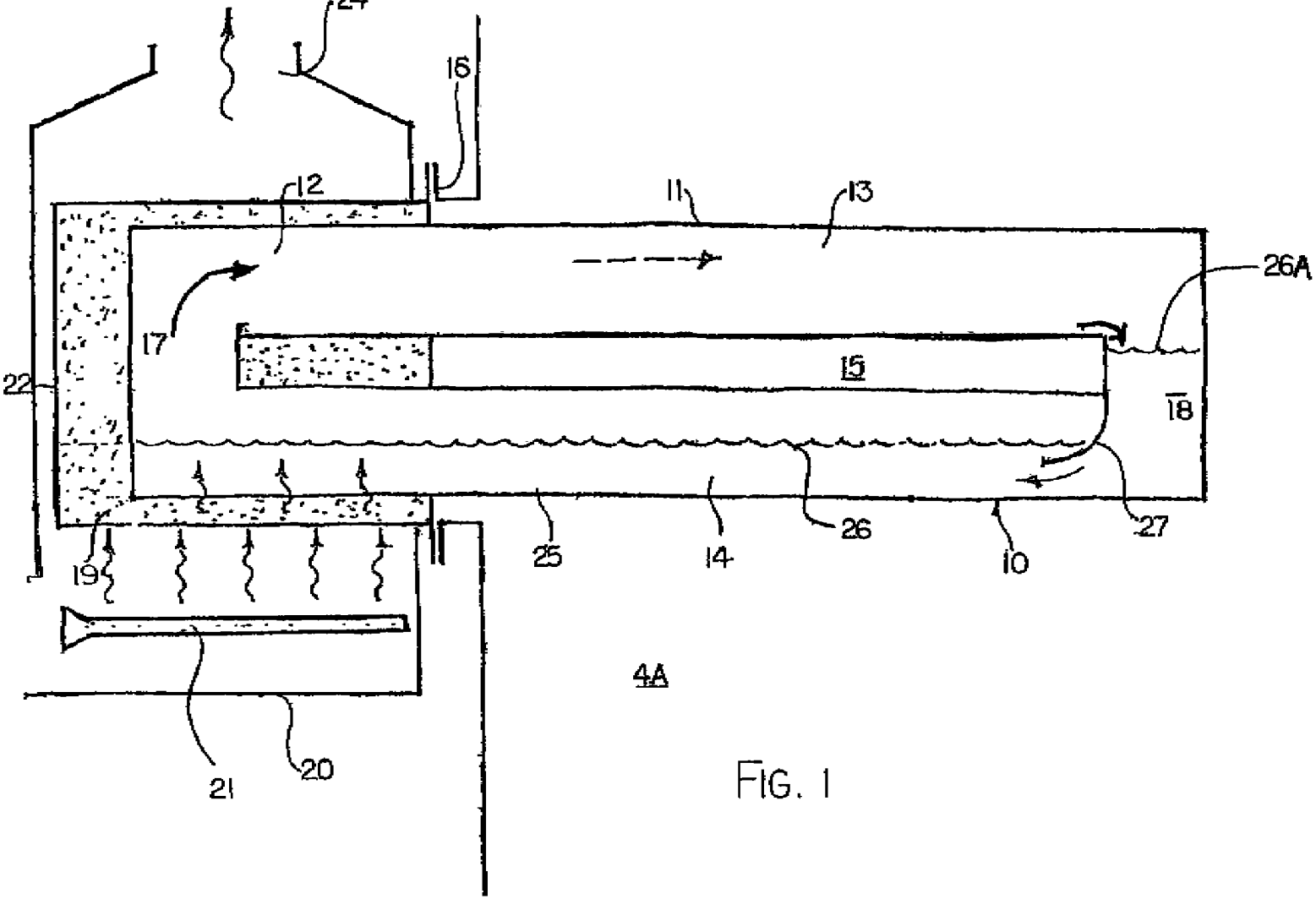
FIG. 1 is a schematic cross-sectional view of a first configuration of heating system according to the present invention for the heating of oil in tanks primarily for separation of water/oil emulsion.
Figure 1A:
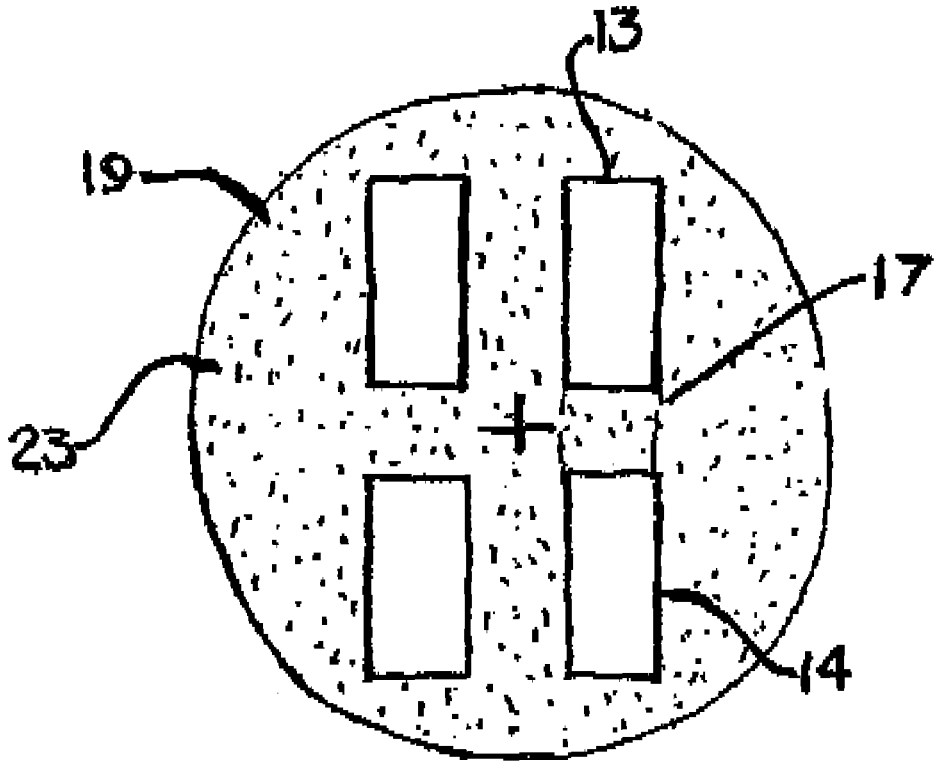
FIG. 1A is a cross-sectional view along the lines A-A of FIG. 1.

FIGS. 1 and 1A show a first configuration which is shown for heating a fluid within a container 4.

It will be appreciated that each of the different configurations shown and described herein can be used in different locations for heating different materials including water, oil or petroleum products and air. Thus in FIG. 2 the configuration is shown for use in heating air within a duct for example in a space heating system for generating heated air for heating a building or for example in heating make up air for applying heat to air taken from the exterior of the building for applying heated air into the building to make up air drawn from the building in ventilation.

Figure 5:
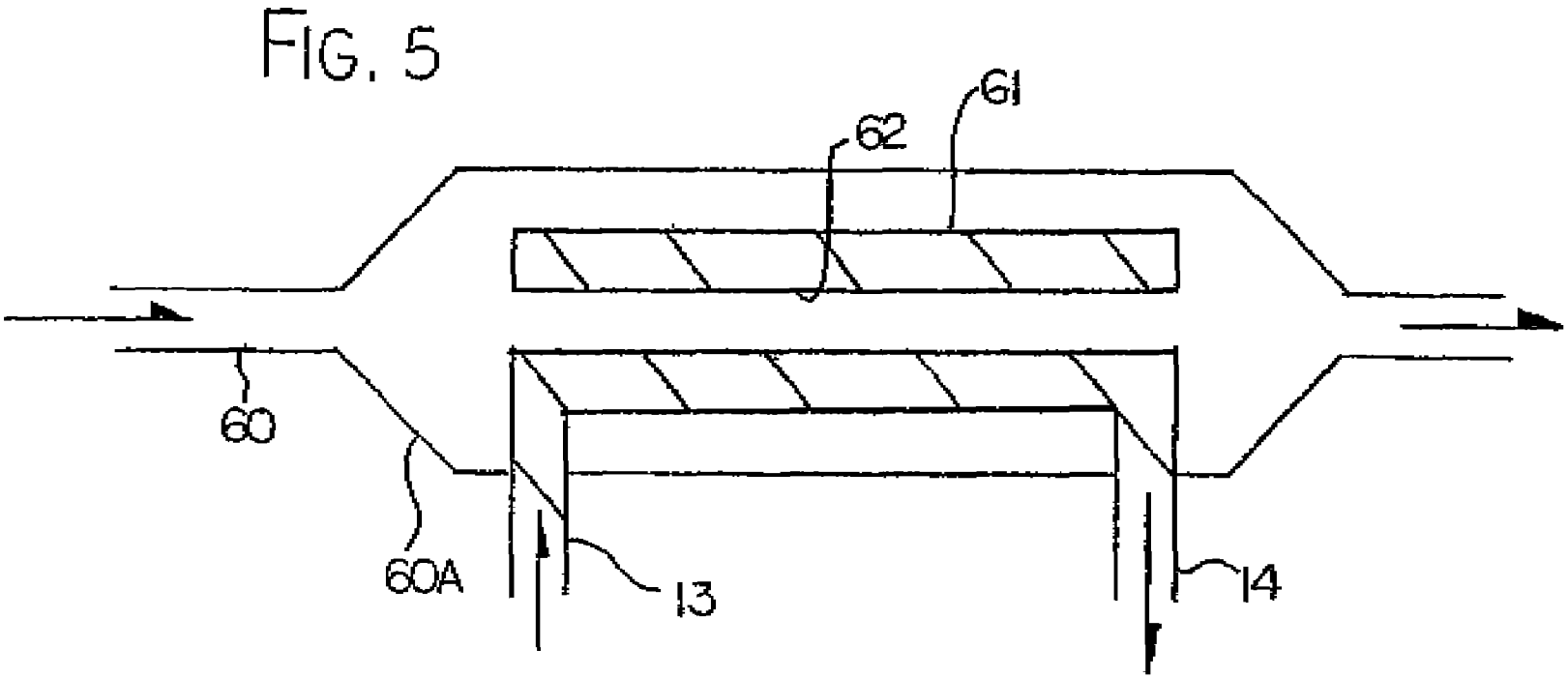
FIG. 5 is a schematic cross-sectional view of a configuration of the condensation section of the conduit for use in heating fluid within a duct.

The configuration shown in FIG. 3 is again shown for heating or other fluid within a tank. The configuration shown in FIG. 5 is shown for heating liquid within a pipe or duct.

However it will be appreciated that the configuration of the evaporation section as described hereinafter can vary and be selected from any one of the configurations shown herein for use with the different fluids to be heated. Yet further additional configurations can be provided for the evaporation section which are not shown herein.

Advantage can be obtained by encapsulation of the evaporation section within a heat communication medium such as a heating oil but this is not essential to any of the configurations shown.

Advantage can be obtained by providing a manifold which connects the evaporation section to the condensation section so that one or more conduit portions from the evaporation section can connect to a different number of conduit portions in the condensation section. However the use for the manifold is not essential and the system can comprise a single complete conduit which communicates with both the evaporation section and condensation section or can comprise a multiple number of separate conduits each independently connected to the evaporation section and to the condensation section.

Turning firstly to FIG. 1 there is shown a first configuration in which the fluid 4A within a tank 4 is heated by a heat loop 10 according to the present invention including a condensation section 11 and an evaporation section 12. The heat loop is formed by a pipe of rectangular cross section including an upper leg 13 and a lower leg 14 which are parallel and spaced by an open section 15 therebetween. The legs 13 and 14 are horizontal and extend from the evaporation section outside the container into the container to the condensation section 11. The heat loops pass through a bulk head 16 of the tank at one wall of the tank.

The horizontal legs 13 and 14 are connected by vertical leg portions 17 and 18 which are short in comparison with the length of the legs 13 and 14.

The evaporation section 12 is located within an encapsulating container 19 which has a cylindrical peripheral wall as best shown in FIG. 1A which fully encompasses the legs 13 and 14 and the leg portion 17. It will be noted from FIG. 1A that there are provided two heat loops side by side and it will be appreciated that the system may include only one such heat loop or a series of such heat loops side by side and spaced within the encapsulation container 19 and extending therefrom into the tank 4. The evaporation section is contained within a housing 20 including a burner 21 which burns a suitable fuel for heating the outside surface of the encapsulation container 19. The ends of the encapsulation container are closed by the bulkhead 16 and by an end plate 22 so as to be fully closed around the evaporation section 12 and to enclose therebetween a heating oil 23 which is heated by the combustion from the burner 21 so as to transfer heat from the outside surface of the encapsulation container 19 to the evaporation section of the heat loops. The housing 20 includes a flue 24 for escape of the combustion products from the burner 21 exiting from the housing 20 outside the container 4.

The heat loop 10 contains a heat transfer medium 25 which is in liquid form at the bottom of the heat loop and in vapor form in the top of the heat loop. The amount of the heat transfer medium is arranged so that the surface 26 is within the leg 14 and is confined by a bulkhead trap member 27 at the junction between the leg 14 and the leg portion 18. Thus the bulkhead trap 27 extends downwardly at the leg portion 18 into the liquid below the surface 26 so as to provide a trap which prevents vapor from entering the leg portion 18 from below thus causing vapor to flow only in the clockwise direction and around the loop and preventing backflow of vapor.

In the evaporation section 12, the liquid is heated so as to generate a vigorous boiling action sufficient to generate vapor rapidly in the evaporation section. The vapor is prevented from running along the leg 14 by the trap 27 and thus must rise along the leg portion 17 and run along the leg 13 to generate a flow around the loop in the clockwise direction. The dimensions of the loop relative to the amount of heat applied through the intermediate heating oil 23 to the evaporation section is arranged so that the vapor moves at high velocity greater than 500 feet per minute and more preferably of the order of the speed of sound so as to generate rapid flow of significant volume of the vapor so as to transfer the latent heat of evaporation of all of that volume of vapor from the evaporation section to the condensation section where all that vapor condenses. The maximum efficiency can be obtained when all of the vapor is condensed and when little or no heat is transferred from the liquid to the fluid for A by cooling the liquid.

It will be noted that in the leg portion 18, there is a volume of liquid up to a surface 26A which generates a head of liquid at a height H which is responsive to a pressure differential across the trap 27. This pressure differential is equal to the drop in pressure caused by the resistance to flow of the vapor within the loop from the evaporation section to the condensation section.

In FIG. 1 is shown a control system 70 for controlling the supply of fuel to the burner. This includes a first temperature sensor 71 in the process liquid, generally oil, within the tank. The sensor may be located adjacent the leg 13 and is used in conjunction with the control system as a thermostat. The control system in response to the measured temperature acts to control the supply of fuel to maintain a required energy supply to maintain a required temperature within the process liquid. A second overpressure or over temperature sensor 72 detects an upper limit pressure or temperature within the system which exceeds a predetermined operating condition. This is normally used to shut down the system in the event that the pressure or temperature exceeds this maximum allowable condition. When heating crude oil or similar materials, the process fluid at start up is often resistant to absorbing heat and thus acts in effect as an insulator surrounding the condensation section. The control system of the present device is arranged therefore at start up to operate in response to the upper limit sensor either to modulate the fuel supply to a rate commensurate with the rate of energy which the process liquid can absorb or to cycle the fuel supply on and off. Thus with the modulation system, the control unit 70 is arranged to detect an over temperature condition and to reduce the fuel supply until that over temperature condition is cancelled. The fuel supply is then gradually increased until the over temperature condition is again reached. The system then operates to find a balance at which the fuel supply is equated to the maximum heat which can be absorbed by the process liquid. As the process liquid increases in temperature its resistance to absorbing heat reduces until it exceeds the maximum energy input, in which case the maximum fuel supply is maintained until the thermostat operates when the required operating temperature is reached. The on-off cycling of the fuel supply can be used in the same manner but is less efficient to increase the temperature of the process liquid at the maximum rate since the fuel supply rate is not optimized. Thus the temperature sensor acts with the control unit as a thermostat at a predetermined set temperature of the oil and the safety over limit detector, which is responsive to an over pressure or over temperature in the conduit, is arranged to modulate or cycle the energy supplied to the evaporation section during a start up phase below the set temperature to maintain heating of the oil while the oil is resistant to absorbing heat.

Figure 2:
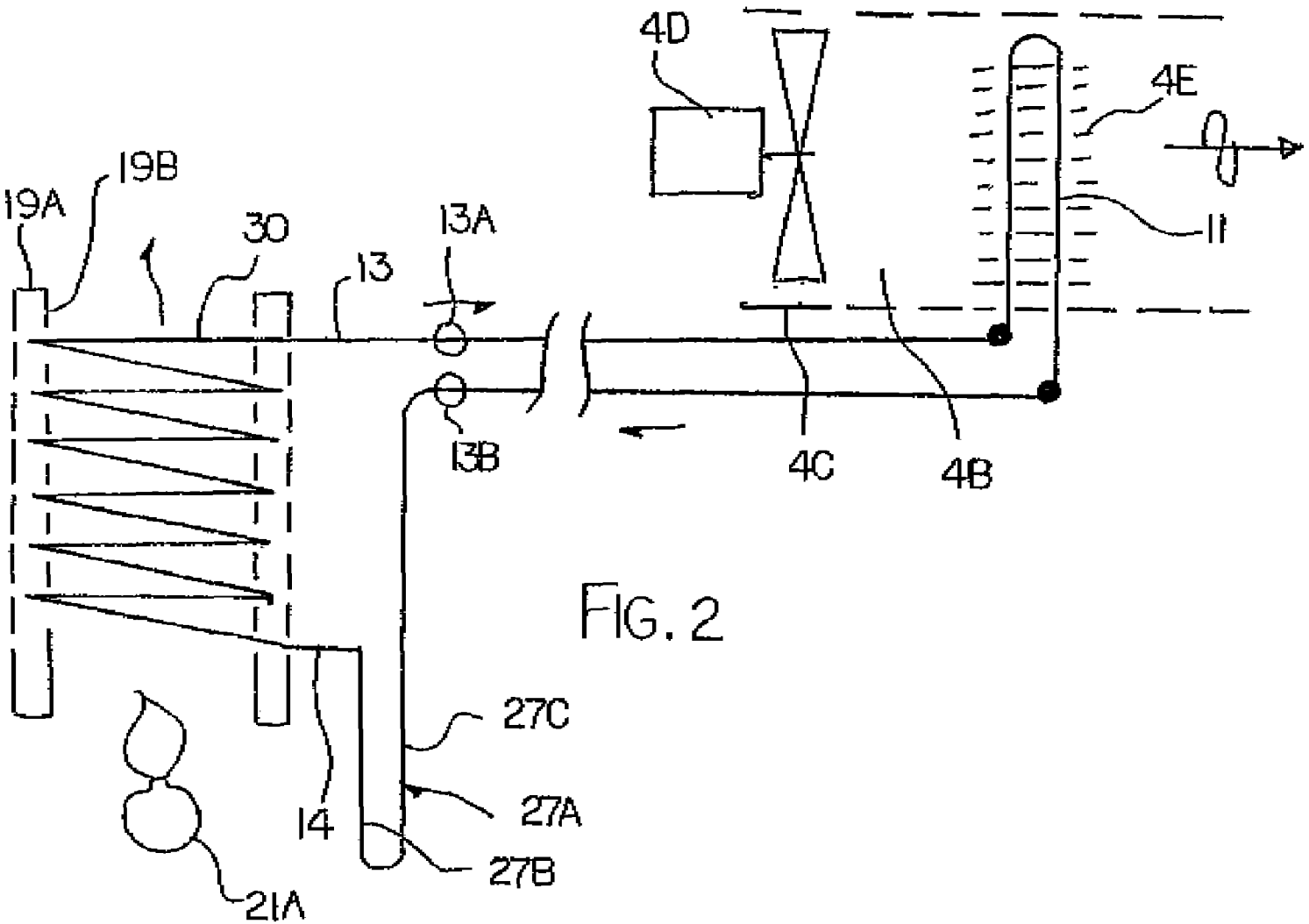
FIG. 2 is a schematic cross-sectional view of a second configuration according to the present invention.

Turning now to FIG. 2, there is shown an alternative arrangement which operates on the same principle but has a number of modifications. The evaporation section is modified so as to provide an improved heat transfer efficiency. Thus the evaporation section comprises a coil 30 of the loop which is shaped into a helix extending from the bottom leg 14 to the top leg 13. The helical coil is mounted within a cylindrical encapsulation chamber 19A with a cylindrical heat receiving surface 19B facing inwardly toward the axis of the cylinder. The burner 21A is located on the axis and comprise a simple single burner nozzle which burns a suitable fuel primarily natural gas which thus can form an unobstructed flame within the combustion zone defined by the inside surface 19B. Between the inside surface 19B and an outside surface of the cylindrical encapsulation chamber 19A is provided a heat transfer oil as previously described.

The coil is spaced from the inner and outer walls of the cylindrical container leaving space for the oil to generate convection currents to transfer heat efficiently and constant temperature from the inside surface to the whole of the coil housed within the cylindrical container.

In this embodiment the trap within the bottom leg 14 is replaced by a U bend form of trap indicated at 27A. Thus there is formed two legs 27B and 27C of sufficient length to contain the head H of the liquid within the leg 27C to match the pressure drop through the loop caused by resistance to flow. It will be appreciated that the resistance to flow within the more complex loop shown in FIG. 2 is higher than that in the simple loop shown in FIG. 1 so that there is a requirement for an increased height of the head H. The head is self adjusting provided the length of the trap is sufficient so that the liquid does not pass the bottom of the trap allowing vapor to bubble over and move in the opposite or counter clockwise direction. This length can be adjusted in order to ensure that the head H has sufficient length by increasing the length of the U-bend. On method by which this can be achieved is by forming the section of the conduit at the U-bend from a flexible pipe material. The U-bend can then be formed by draping the flexible material over suitable supports arranged to provide the required leg length. The trap shown in FIG. 2 is outside the evaporation section separate therefrom allowing such adjustment to be readily effected depending upon actual conditions in an installed location of the system. The vaporizer section thus may be connected to the condenser section with flexible hose which would permit the vaporizer to be located at lower level than the condenser within the capability of the system to maintain desired fluid flow characteristics. So that the vaporizer sits on the ground and condenser tubes are at a higher level.

In FIG. 2 the upper leg includes a manifold 13A and the lower leg includes a manifold 13B allowing the manifolds to be connected to a plurality of the loops within the condensation section. Thus a single coil may be connected to a plurality of condensation loops or a plurality of coils may be connected to a single condensation loop or a plurality of coils may be connected to a plurality of condensation loops.

In FIG. 2, the fluid to be heated is air 4B within a duct 4C driven by a fan 4D. The loop 11 in the condensation section may be a complex multi pass loop including fins 4E so as to provide a large surface for engaging the air within the duct.

Figure 3:
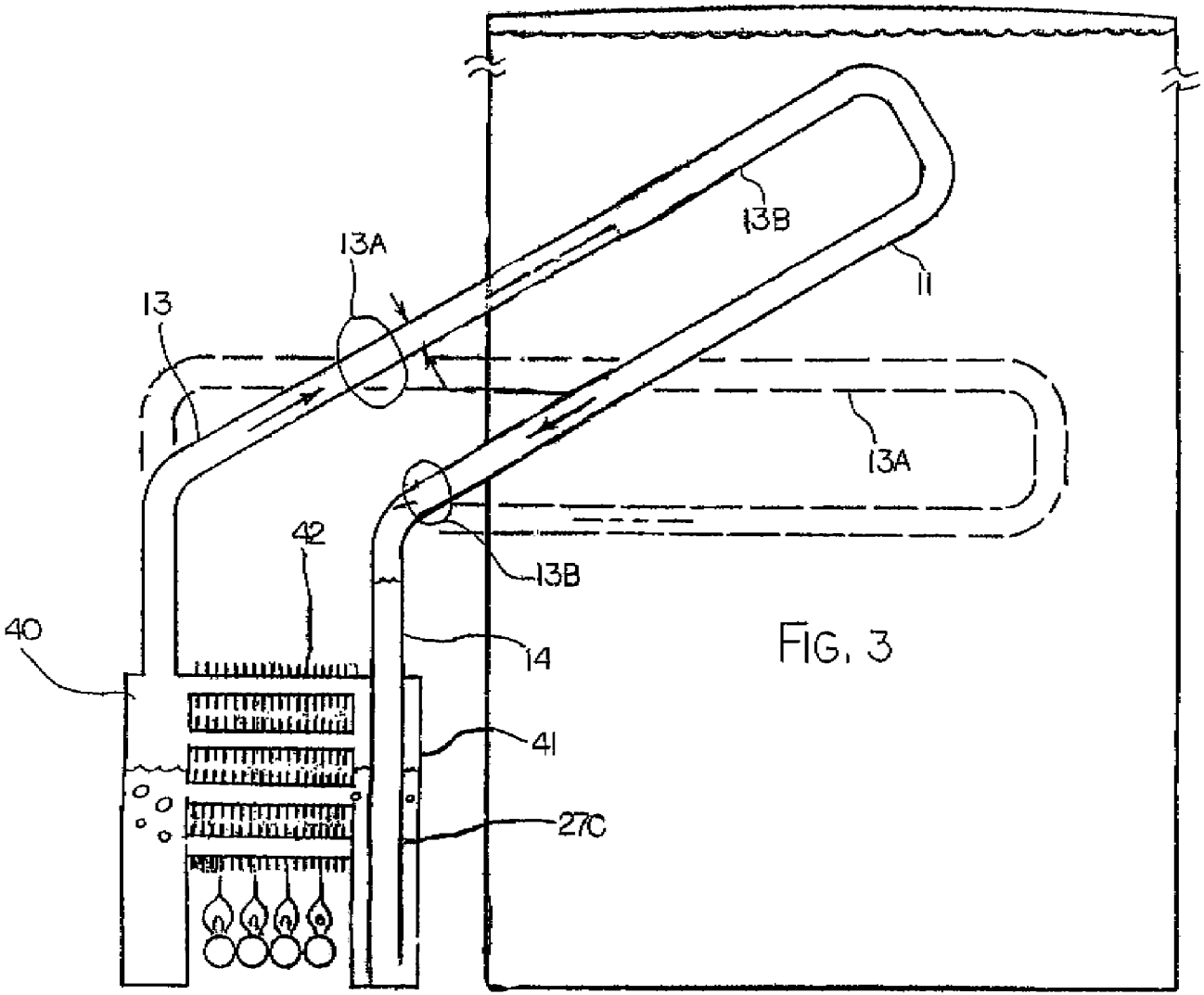
FIG. 3 is a schematic cross-sectional view of a third configuration of heating system according to the present invention.

In FIG. 3 is provided an arrangement including the manifold 13A and 13B. On the condensation side of the manifold is shown a single loop in the condensation section indicated at 11 of a simple nature. Again the loop may be more complex including a plurality of such loops in parallel or in series. The loop in the condensation section 11 maybe arranged so that the legs are horizontal as indicated in dash line 13A or the legs may be inclined upwardly as indicated in solid line 13B. It will be appreciated that the inclined arrangement shown at 13B provides additional gravitational forces for carrying the condensate back to the return manifold 13B. However the flow necessary to carry the medium to the top of the loop provides an additional resistance to flow which thus may require an increased height H of the head of the liquid within the trap. The velocity of the flow is arranged so that the condensate within the first leg is carried by the vapor so that none returns to the evaporator section along the vapor leg but all is carried around at the end of the loop into the condensate leg to return to the evaporator section through the condensate leg and through the trap.

In the embodiment of FIG. 3 the evaporation section is defined by a pair of spaced tanks 40 and 41 which are connected by transverse heat transfer tubes 42. The arrangement of the heat transfer tubes is shown in more detail in the figures described hereinafter. The vapor leg 13 is connected to the top of the tank 40 and receives vapor therefrom. The leg 14 extends to the bottom of the tank 41 to form a trap 27C. The burner 21 is located between the two tanks to apply heat to finned heat transfer tubes 42. The liquid within the tanks communicates through the tubes 32 and boils within the tubes 42 so as to generate vapor in the upper part of the tanks and the upper tubes and to generate sufficient vigorous boiling action so that the liquid also enters the upper tubes and keeps the upper tubes wetted. The vigorous boiling action generates high velocity vapor which enters the leg 13 and is prevented from entering the leg 14 by the trap 27C.

Figure 4:
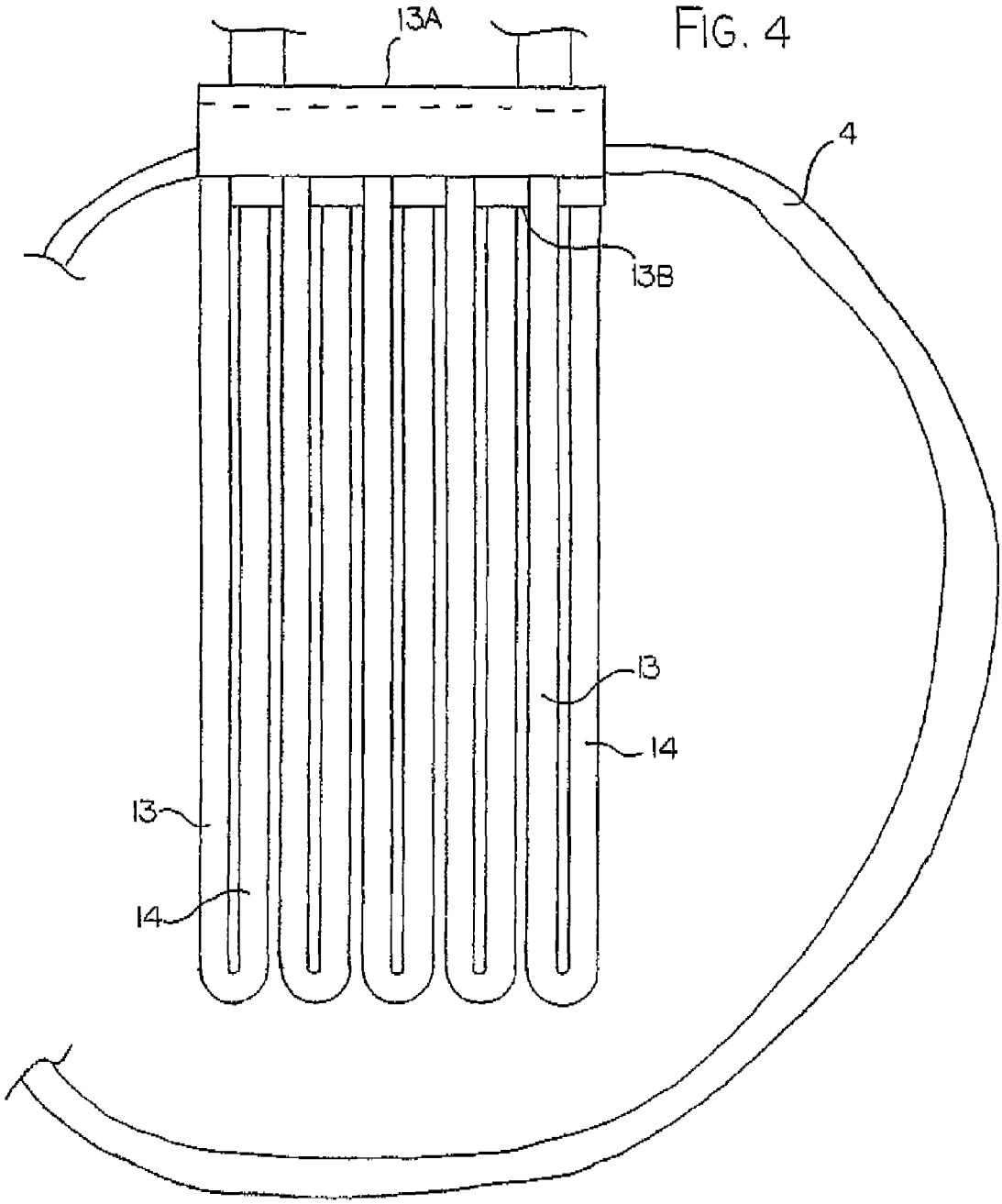
FIG. 4 is a top plan view of the condensation section of the heating system of FIG. 2 which is within the tank.

In FIG. 4 is shown the manifolds 13A and 13B on the exterior of the tank 4. The manifolds are connected to a plurality of the loops, each including an upper leg and a lower leg 14 extending from the manifold 13A to the manifold 13B. It will be noted that in FIG. 4 the bottom leg 14 is offset to one side of the top leg 13 so that the leg 13 does not lie directly vertically above the leg 14 but instead both are exposed in plan view. This arrangement maybe provided in order to allow increased communication of heat by convection in the vertical direction from the upper surfaces of the legs 13 and 14.

Figure 6:
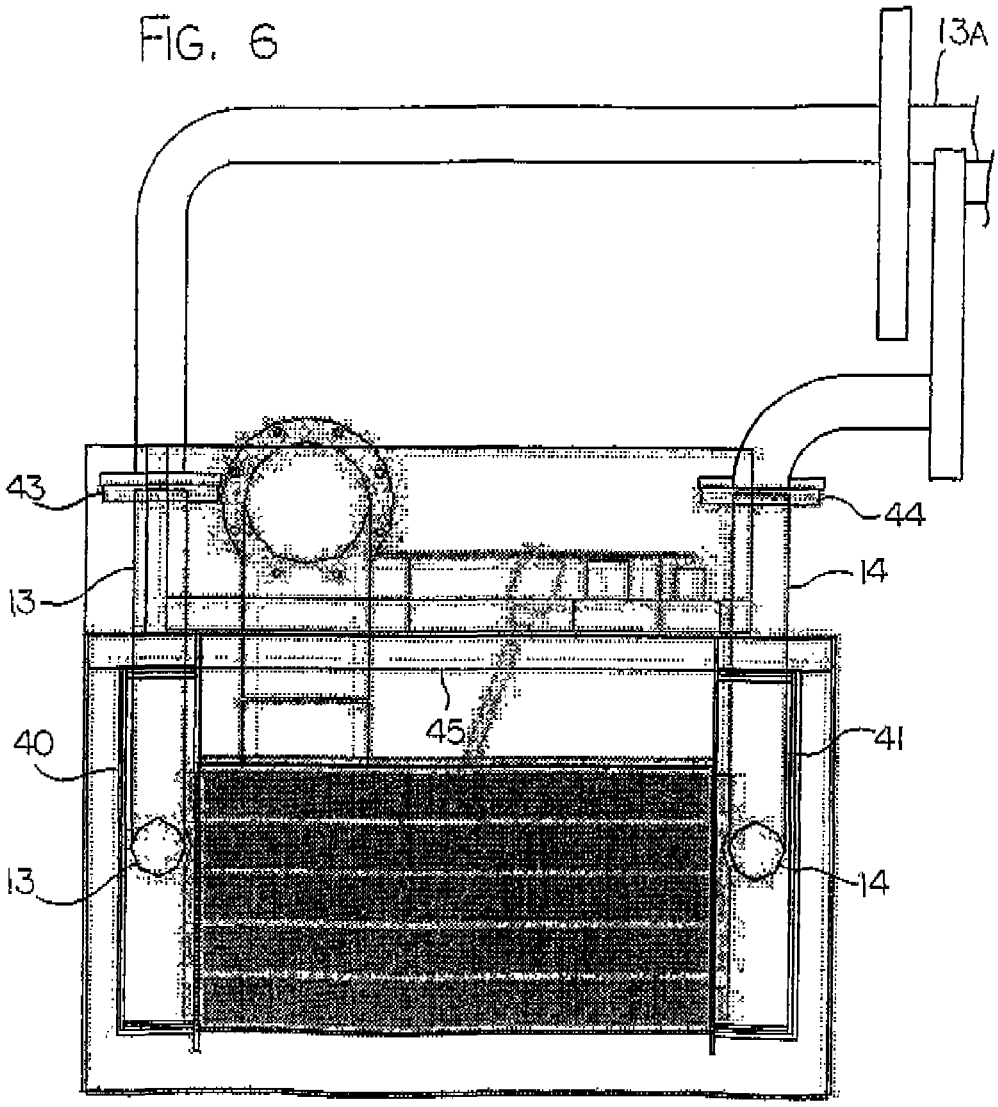
FIG. 6 is a top plan view of a the evaporation section of the heating system of FIG. 3 which is arranged for connection to the section shown in FIG. 4.
Figure 7:
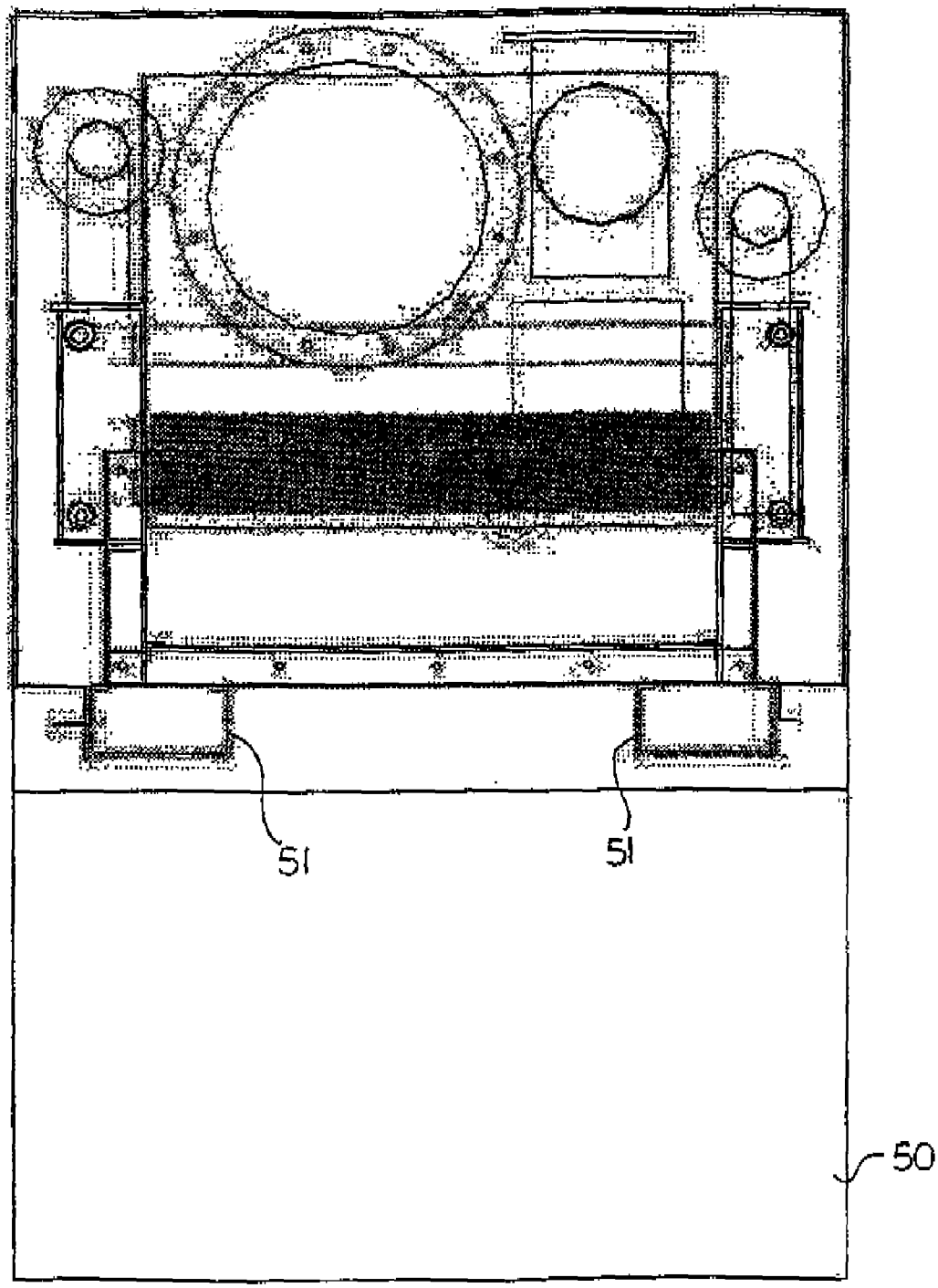
FIG. 7 is a front elevational view of the evaporation section of FIG. 6 of the heating system of FIG. 3.
Figure 8:
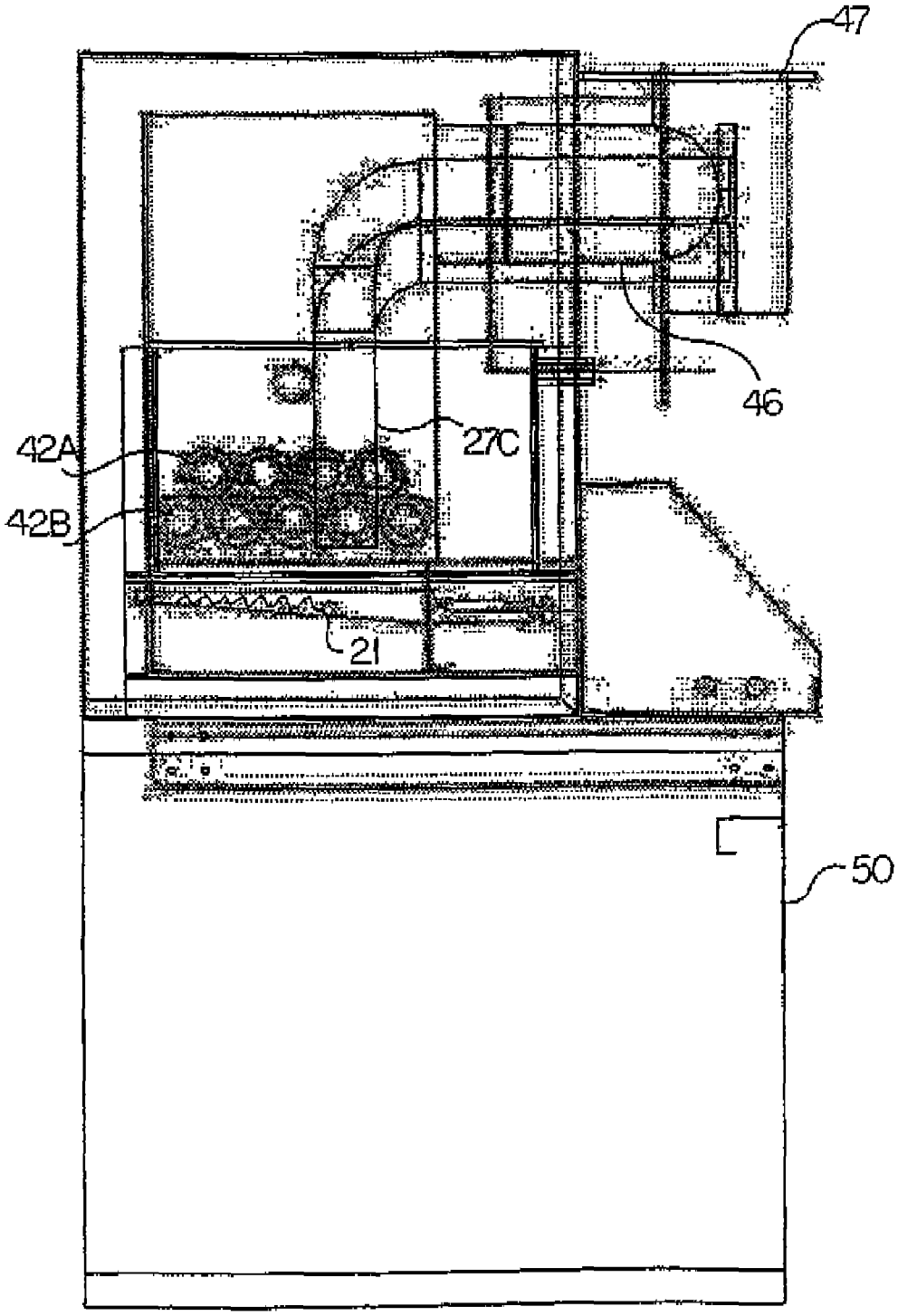
FIG. 8 is a side elevational view of the evaporation section of FIG. 6 of the heating system of FIG. 3.

Turning now to FIGS. 6, 7 and 8, there is shown more detail of the configuration of evaporator section shown in FIG. 3. Thus the tanks 40 and 41 shown in plan view in FIG. 6 are connected to the pipes 13 and 14 which extend to a connector plate 43 and 44 respectively for connection to an additional duct portion extending from the connector plate to the respective manifold 13A, 13B. The tubes Interconnecting the tanks 40 and 41 are arranged in two rows 42A and 42B with the row 42A arranged between the tubes of the row 42B so as to allow heat and combustion products passing between the tubes of the row 42B to impact upon the underside of the tubes of the row 42A. This configuration improves the communication of heat from the burners 21 underneath the tubes to the tubes and to the liquid boiling within the tubes. A flue vent is communicated with the chamber 45 surrounding the tubes on the combustion zone and extends from the top of the combustion zone rearwardly and then upwardly to a top connection plate 47 of the flue 46. The legs 13 and 14 include horizontal portions extending rearwardly together with vertical portions which extend downwardly into the top of the respective tank at a position midway across the width of the tank. The combustion chamber is mounted on a stand 50 which is located under suitable frame members 51 of the structure which support the combustion chamber.

In FIG. 5 is shown a concentric arrangement which is provided as a condensation section from the leg 13 to the leg 14 where the condensation section is formed as a hollow cylinder within a duct 60. Fluid flowing within the duct thus enters a wider section of the duct as indicated at 60A within which is located the hollow cylinder 61 forming the condensation section. Thus the fluid within the wider section 60A can pass around the outside of the hollow cylinder and also through an interior 62 of the hollow cylinder to provide an increased contact surface between the condensation section and the fluid to provide an improved heat transfer therebetween as the medium condenses within the condensation section.

The condenser heat exchanger which is a hollow section metal may have a single vaporizing section or may lead to one or a multiplicity of condensing sections.

The vaporizer water legs are fabricated metal containers forming manifolds for the condenser heat exchanger sections.

The vaporizer heat exchanger is a hollows section metal which may be finned and can be increased or decreased in number and length in order to increase or decrease efficiency of heat exchange from heating source.

The heating medium may be any liquid or liquid mix, typically water or water/glycol, generally including a metal passivating agent.

The heat source may be a direct flame from an introduced flame, or could also be heated via a secondary heating medium such as hot oil delivered to an encasement around the vaporizer heat exchanger tubes. A common source of hot oil can heat either a single or a multiplicity of Heat Driven Loops.

The pressure differential trap may be a condenser return leg extended down into the condensate tank.

The liquid level differential and pressure creates pressure that impels vapor into outlet leg of condenser and prevents back-flow of vapor into return leg.

Vapor flow, that is the velocity of vapor, as dictated by the cross sectional area of the outlet leg, the resistance to flow of the condenser, and the pressure differential across the outlet and return legs of the condenser created by the liquid level differential in the trap, carries all condensate in the direction of vapor flow.

Condensate flow, that is the condensate driven back to the vaporizer is effected by vapor flow but there may be some gravity assistance if condenser operating angle is above horizontal.

This allows a range of condenser operating angles from horizontal. The. above principle is expected to be effective in moving the major flow of condensate in the same direction as the vapor at angles of at least 10 degrees from horizontal. 'Effective' can be defined as substantially achieving the enhancement of heat exchange associated with uni-directional flow of vapor and condensate as opposed to counter-directional flow. Theoretically, by increasing the trap differential pressure and regulating the size of the outlet leg of the condenser, the angle from horizontal could be extended to 90 deg.

There is a region of turbulent boiling in the sealed system and the starting pressure can be regulated to anything that can be achieved above a complete vacuum. Having established the starting pressure, the void space is generally purged with an inert gas, such as argon. Especially under vacuum conditions, boiling will be turbulent with large bubbles of steam carrying globs of liquid along with it, but without the liquid bridging the conduit to avoid the formation of a bubble pump. These globules of water will splash Into the upper vaporizer heat exchanger tubes keeping them wet, and, to some extent, be carried into and possibly through the condenser.

It is the adjustability of the differential pressure between the supply and return legs of the condenser plus the ability to achieve higher pressures sufficient to overcome resistance imposed by more complex configurations, even involving the entraining and lifting of condensate, that distinguishes the arrangement of FIG. 3 from the arrangement of FIG. 1 of the technology. The arrangement of FIG. 1 has its particular merits in that it has a very simple layout that does not rigidly confine the heating medium in any part of it. Therefore the medium can be water only, which can freeze without the accompanying expansion damaging the device, and that the device can be fired without harmful effects from a frozen condition. Utilizing water only can present an advantage in that exposure to heat can cause breakdown of chemically more complex substances [such as glycol]. In the oil industry, these devices will commonly be used outdoors, so these qualities could be of significance.

Other load demands could consist of mechanical utilization of energy. This would include, for example, the driving of a turbine for any number of purposes including the generation of electricity, the direct driving of a pump, fan, etc.

It may be possible to utilize mechanical back-flow resisting devices such as ball-check, swing-check, or, spring-loaded valves such as to increase resistance to back pressure. However in practice, mechanical methods of blocking back pressure may be impractical in that they eventually will require maintenance. Conventional steam traps, for example, are susceptible to occasional problems. Compared to conventional steam systems, the present invention may use different liquids, higher temperatures, higher vapor and condensate velocities etc, plus a need for rugged reliability. It is one of the distinguishing features of the present arrangement that it is entirely 'thermodynamic', i.e., heat driven, without any moving parts.

One problem which can arise is the accumulation of inert gases which is a commonly encountered phenomenon with this type of technology. A gradual build-up of inert gases occurs in these systems, depending on materials utilized and chemical action between them, which displaces vapor and decreases effectiveness, which, with single tube technology, sometimes determines service life because its effects are not readily monitored or remedied. It is inherent to the present principal of operation that this major concern becomes much more manageable and is therefore an important feature of the invention.

A loop with significant force of flow such as the present arrangement, has the advantage that any inert gases in the system will be driven into what Is referred to as an accumulation sector, which is the sector of the loop just before the trap and will be confined there while the system is in operation due to the forward flow of the vapor and the locking or trap effect of the liquid in the trap. Thus an access opening 75 is located immediately in advance of the trap for sampling of the presence of inert gases and for purging of those gases. It will be appreciated that in the presence of such gases, the opening of the access opening by service personnel will cause the vapor pressure and flow to discharge the inert gases through the opening until the presence of vapor in the discharge indicates that all gases have been purged. Such inert gases may be introduced for purging and subsequently not fully evacuated, such as argon which is commonly used for this purpose, and/or produced as a result of chemical activity such as hydrogen as from reaction between water and iron, the predominant element in mild steels and present to some degree in stainless steels, and which occurs even in the absence of free oxygen, hence the need for passivating agents. With the arrangement as described herein, that sector would normally be out of or at least extending partly out of the immersed portion of the heating element, the significance being that it is accessible in that it will not be completely Immersed. The build up of inert gases can be detected by a decrease in temperature in an area of the conduit immediately upstream of the trap which is caused by the inert gases preventing the vapor from condensing in that area and thus properly heating the conduit. Thus the temperature at this area can be monitored on an ongoing or periodic basis to detect an unacceptable build up of the inert gases. Alternatively, the inert gases when they build up will reduce the vacuum in the system when shut down and again their presence can be detected by service personnel carrying out a pressure test at shut down and detecting the presence or reduction of the initial preset vacuum level.

With single tube technologies whether tubes are employed singly or in a plurality, such as conventional heat pipes and thermo-siphons, as in the prior art of Spehar and Neulander mentioned above, and which are commonly employed sloped upwards into the vessel, the inert gases accumulate and remain, whether the system is in or out of operation, in what is referred to as a 'block' in the high end of the tube, which is the sector furthest immersed in the process fluid and most inaccessible.

In a sector where there is such accumulation of inert gases, heat exchange is significantly impaired because the inert gases block out vapor and preclude the change of state which is the substantial means of conveying heat. Only sensible heat from liquids that may flow through the sector would be transmitted from the accumulation sector.

With loops, the decline is such that effective heat exchange is significantly impaired but not altogether eliminated because there is at least some sensible heat available from condensate and throw-over liquid flowing through that sector. At the boundary between the sector of the heating element that is performing normally and maintaining a substantially constant temperature, and the sector where there is accumulation of inert gases, heating element temperatures start to decline in an observable, significant, and regular fashion.

However, with single tubes, there is no such flow of liquid and heating element temperatures will decline much more drastically and that sector is effectively 'blocked', or idled, for heat exchange purposes. Moreover, with loops, when in full operation and the system under positive pressure, the accumulation is moved to a sector that is normally accessible for measurement of temperature, the difference between the entry temperature of vapor to the heating element and the temperature in the accumulation sector being an indication of the degree of accumulation of inert gases, and purging of the inert gases, utilizing the operating pressure of the system itself, usually from the highest point in the system just prior to the trap.

There Is no practically convenient means of either measuring, or even detecting, such accumulation with single tubes, which occurs at its greatest extension into the process fluid, and similarly, no practically convenient means of purging such accumulation if it could be detected. With single tubes, such measurement and purging devices would have to extend back through the tubes themselves or through the vessel. These are very difficult environments warranting correspondingly expensive solutions compared to the simple access provided by the present system.

This a significant improvement presented by the present system over all single tube technologies also over the prior art of the Grunes et al technology when operating below that critical level where it flips from unidirectional flow, which causes such accumulation to occur in a sector next to the trap as above, to counter-directional flow which, with its particular configuration, would likely cause dispersion of the inert gases throughout the system while in operation which would generally impair effectiveness, and, accumulation at a highest point when not in operation.

The heating of water and petroleum products, especially crude petroleum products that are towards the 'heavy', that is comparatively viscous end of the scale, present differing problems. Water is comparatively easy to heat. Resistance to heat transfer is at its minimum at commencement when temperature differential is at its greatest and increases as temperature rises. Convection currents are readily established and the whole process is quite dependable and predictable. For heating purposes, water properties are 'constant', on both a case to case basis, and with respect to any individual case. With petroleum, on the other hand, heating properties are much more variable and complex in that:

[a] Petroleum has 'non-Newtonian' flow characteristics. This has to do with viscosity varying not only with temperature but with also flow velocity and boundary effects between currents in different directions in the same vessel. In other words, flow, particularly convection flow, tends to be affected in rather unpredictable ways by specific configurations of vessels and heating elements. This effect tends to be more pronounced with heavier, more viscous, petroleum products.

[b] Crude petroleum product varies greatly in content and characteristics; viscosity of liquid petroleum product, proportion of liquid petroleum product, amount of entrained gaseous petroleum product, proportion of water, salinity of water, amount of entrained particulate matter, sand, usually and associated more with heavier product, these would be the main variables.

[c] Boundary effects between the heating elements and petroleum products are much more problematic, with crude petroleum especially, in that; resistance to heat transfer will always be higher than with water and will be variable depending on the effects of all of the forgoing, and, the flashing of petroleum products and/or entrained water into gases causes foam to collect in the immediate vicinity of heating elements which further resists heat transfer.

[d] Also, petroleum products, particular heavier crude products, have a tendency to 'channel', at least initially, when being heated, i.e., set up localized convection currents which get hotter, less viscous, and therefore more active, while bypassing volumes of un-circulating and unheated liquid. Eventually, enough heat is transmitted to these un-circulating volumes that they become entrained in an overall convection flow pattern.

[e] The foregoing are 'non-constant', as well as variable, in the sense that same configurations do not always set up same flow patterns and rates of-heat transfer, as is the case with water, because the summation of the effects of the foregoing always produce some net differences with respect to flow and heat transfer characteristics and these differences are often not of an observable nature and scale.

With water, the heat loop system may have a heat transfer rate of 10,000 btuh/sq.ft. of heat exchange surface at commencement of heating at somewhere just above freezing which will decrease in a regular fashion to perhaps 8,000 btuh/sqft when the water reaches a control temperature of somewhere just below boiling. With a vessel of a given size and configuration, filled to a given level, and heated with a heater of a given size, configuration and capacity, this type of result will not vary from instance to instance.

With petroleum product, at commencement of heating with cold, stiff and highly adulterated product, the initial heat transfer might be very low, say in the order of 200 btuh/sq.ft. of heat exchange surface. This may rise to 1000 btuh/sqft as convection circulation is established and then decrease to 800 btuh/sqft as control temperature is reached. As previously indicated, this may vary from instance to instance, even in a given application.

The differences between the heat transfer characteristics of water and petroleum products tends to be amplified with; cruder, as opposed to more refined, and, heavier, as opposed to lighter, petroleum products.

In other words, the technology must cope not only with great variation in demand, but great variation in heat transfer characteristics as load is imposed. It is inherent to the present design that it will self-adjust to all of his—there will be unidirectional flow from startup to shutdown, and at all levels, of operation.

That is not the case with the Grunes et al technology. Heating potable water is an application that lends itself readily to full on/full off operation. It is inherent to the Grunes et al technology that it will tend to flip back and forth between two modes of operation at intermediate levels of operation. It must get up to some minimum level of operation to either; flip over through boiling action, or create through condensation, enough liquid to maintain a level in the accumulator, which is critical to establishing and maintaining unidirectional flow. At below that level of operation, the restriction and the accumulator associated with it, which has a largely fixed, at least a minimum, draining rate, will remain clear of liquid. Vapor and condensate will flow in opposite directions in both legs of the device in the manner of a conventional, single tube thermo-siphon. It could actually be considered to be two single tube thermo-siphons abutting each other at both ends.

The arrangement of the present invention has an improved operation because:

[a] the amount of material employed in relation to the amount of heat transferred. Because transfer is being accomplished by change of state, the amount of energy that can be transferred by a given amount of fluid is proportionate to the rate at which the fluid is circulated each cycle representing the transfer of the total latent heat capacity of the amount of fluid in the system. By maximizing flow rate and therefore heat transfer rate both the amount of fluid required and the amount of material required to create the necessary volume to contain it will be minimized. That would be within the physical capability of the system to transfer heat in and out, of course, but that too can be enhanced in relation to volume enclosed by the addition of suitable fins to facilitate heat transfer, encapsulation to maximize average contact temperature, etc. Maintaining flow rate of vapor and condensate in one direction, as compared to vapor in one direction and condensate in the other and resisting each other, at all levels of operation, will maximize effectiveness. The capability of accomplishing and maintaining that at all levels of operation in this particular application represents a considerable improvement.

[b] the ability of the device to sustain a driving force through the system at all levels of operation. This extends beyond [a] above in that there are potential applications where the ability to create pressure differentials and overcome resistance is a critical to the devices operation. This would include any application where the system is utilized to perform a mechanical function. With the Grunes et al technology, at below some critical level of operation, such a device would cease to operate.

Points [a] and [b] in particular are general advantages that the present technology presents over the Grunes et al technology. The capability of maintaining stable operation under varying and unpredictable loading, a common condition in some aspects of petroleum processing, particularly with cruder and heavier products, is a specific advantage in that application but presents potential advantages in other applications as well. Point [b] above is not directly associated with the heating or processing of any particular substance it is simply an advantage to have a device that provides a force to operate something to be capable of doing so throughout a full range of operating levels as opposed to just an upper portion of that range.

There are a number of different types of traps which are possible for use with this construction;

1. A submerged bulkhead which is shown in FIG. 1. With this configuration, the liquid must flow under a bulkhead to pass into the vaporizing area. The down-leg of the trap is made distinct from the vaporizing area by this panel but the up-leg of the trap and the vaporizing area are one and the same.

2. The "U" Trap shown in FIG. 2. The legs of the trap are separated by being placed in separate vertical conduits joined at the bottom with the up-leg of the trap leading into the bottom of, and is distinct from, the vaporizing area.

3. The Down-leg Trap shown in FIG. 3. In this configuration, the up-leg of the trap and the vaporizing area are one and the same.

All these work according to the same principle—back pressure in the vaporization area opposed and balanced by liquid level differential pressure in the trap. The range of back pressure that can be tolerated can be adjusted in all three cases by increasing the depth of the trap.

The "U" Trap configuration presents the advantages;

It is a simple and straightforward matter involving minimal additional material to increase its pressure range by making the "U" deeper, whereas increasing the range of the other configurations would involve deepening the whole vaporization area, which would involve considerably more bulk, and, it is inherent to the "U" Tube approach that violent boiling action will not penetrate through to the up-leg because the up-leg will always be in its entirety below the boiling area, which is not necessarily the case with the other two configurations. It could be claimed that these configurations are more susceptible to violent boiling action reaching the up-leg of the trap which would then nullify or substantially impair the desired effect of driving flow in one direction.

However, having said all that, it is a simple matter to adjust the other configurations to these disadvantages simply by having the bulkhead and the open-ended conduit descend into a well provided for that purpose in the bottom of the vaporization area.

The submerged bulkhead and the Down-leg traps have an advantage over the "U" Trap in that extra material is not required for the up-leg.

The down leg trap shown in FIG. 2 has the advantage that the condensate is collected in the heating source and hence remains heated without losing any heat by sitting in a separate or exposed trap. This could be overcome by providing suitable insulation.

The invention claimed is:

1. A method for transferring heat from a combustion heat source to a fluid to be heated comprising:

providing a combustion heat source;

providing a fluid to be heated at a position spaced from the heat source;

providing a closed system including at least one conduit;

providing an evaporation section of the closed system at the heat source;

providing a condensation section of the closed system in the fluid to be heated;

providing a heat transfer fluid medium within the closed system having a temperature of boiling from liquid to vapor such that heat from the heat source causes the liquid to boil to form a vapor in the evaporation section and such that release of heat from the condensation section to the fluid to be heated causes the vapor to condense to liquid in the condensation section;

the at least one conduit forming a loop extending from the evaporation section through the condensation section and back to the evaporation section so as to conduct the heat transfer fluid medium from the evaporation section to the condensation section and back to the evaporation section;

applying heat energy to the heat transfer medium by the heat source at the vaporizer section;

the conduit and condensation section having a resistance to flow of the vapor from the vaporizer section to and through the condensation section;

providing a trap having a trap leg defining a column of liquid in the conduit at a position adjacent to or at the evaporation section;

and arranging the trap leg such that, subsequent to start-up and during steady state flow of the heat transfer fluid medium in the loop, the column of liquid in the trap leg is caused to reach a height which defines a pressure in the liquid at least equal to a pressure drop in the vapor caused by the resistance to flow of the vapor in the conduit from the evaporation section to and through the condensation section.

2. The method according to claim 1 wherein the flow of the heat transfer medium around the loop is caused by energy supplied substantially solely by the heat source without assistance from a pump.

3. The method according to claim 1 wherein the flow of the heat transfer medium around the loop is caused without assistance from mechanical propulsion of the medium.

4. The method according to claim 1 wherein the trap leg has a length greater than the required column of liquid so as to allow self-adjustment of the column of liquid within the trap leg.

5. The method according to claim 4 wherein the length of the trap leg is adjustable and is adjusted to provide a length matched to the length of the column of liquid.

6. The method according to claim 5 wherein the trap leg is formed by a portion of a flexible pipe allowing the length of the trap leg to be adjusted by moving the portion.

7. The method according to claim 1 wherein at least part of the condensation section is raised above the evaporation section such that condensate can flow under gravity back to the evaporation section via the trap.

8. The method according to claim 1 wherein the flow of vapor from the evaporation section to the condensation section is at sufficient velocity to carry all condensate forwardly to a position where it can flow around the loop under gravity back to the evaporation section via the trap.

9. The method according to claim 1 wherein substantially all the vapor generated in the evaporation section is caused to condense in the condensation section.

10. The method according to claim 1 wherein substantially no heat transferred is transferred to the fluid to be heated by cooling of the condensed liquid.

11. The method according to claim 1 wherein the vapor flow and the trap are arranged such that inert gases collecting in the system are driven to a location immediately upstream of the trap.

12. The method according to claim 1 wherein there is provided a discharge opening immediately upstream of the trap which is opened to cause purging of collected inert gases.

13. The method according to claim 1 wherein the evaporation section comprises a container for the liquid with the conduit connected to the top of the container to receive vapor therefrom.

14. The method according to claim 1 wherein there is provided an intermediate heating oil to transfer heat from the heat source to the evaporation section so as to allow protection of the structure of the conduit both at high temperatures against heat damage and at low temperatures against corrosion from condensate.

15. The method according to claim 14 wherein the heat transfer oil is located in a cylindrical body defining a cylindrical interior wall and a cylindrical exterior wall with the evaporation section therebetween in the form of a helical coil and with a burner inside the interior wall providing combustion in a chamber defined by the interior wall.

16. A method for transferring heat from a combustion heat source to a fluid to be heated comprising:

providing a combustion heat source;

providing a fluid to be heated at a position spaced from the heat source;

providing a closed system including at least one conduit;

providing an evaporation section of the closed system at the heat source;

providing a condensation section of the closed system in the fluid to be heated;

providing a heat transfer fluid medium within the closed system having a temperature of boiling from liquid to vapor such that heat from the heat source causes the liquid to boil to form a vapor in the evaporation section and such that release of heat from the condensation section to the fluid to be heated causes the vapor to condense to liquid in the condensation section;

the at least one conduit forming a loop extending from the evaporation section through the condensation section and back to the evaporation section so as to conduct the heat transfer fluid medium from the evaporation section to the condensation section and back to the evaporation section;

applying heat energy to the heat transfer medium by the heat source at the vaporizer section;

the conduit and condensation section having a resistance to flow of the vapor from the vaporizer section to and through the condensation section;

providing a trap having a trap leg defining a column of liquid in the conduit at a position adjacent to or at the evaporation section;

and arranging the trap leg such that, subsequent to start-up and during steady state flow of the heat transfer fluid medium in the loop, the column of liquid in the trap leg is caused to reach a height which defines a pressure in the liquid at least equal to a pressure drop in the vapor caused by the resistance to flow of the vapor in the conduit from the evaporation section to and through the condensation section;

and causing boiling of the liquid in the evaporation section and flow of the vapor from the evaporation section to carry non-vapor additives in the liquid in the evaporation section into the conduit with the vapor.

17. The method according to claim 16 wherein the conduit is arranged relative to the evaporation section such that boiling of the liquid in the evaporation section does not cause liquid to bridge the conduit so as to act as a bubble pump.

18. The method according to claim 16 wherein the conduit is arranged relative to the evaporation section such that the velocity of the vapor is greater than 500 ft/sec.

19. A method for transferring heat from a combustion heat source to a fluid to be heated comprising:

providing a combustion heat source;

providing a fluid to be heated at a position spaced from the heat source;

providing a closed system including at least one conduit;

providing an evaporation section of the closed system at the heat source;

providing a condensation section of the closed system in the fluid to be heated;

providing a heat transfer fluid medium within the closed system having a temperature of boiling from liquid to vapor such that heat from the heat source causes the liquid to boil to form a vapor in the evaporation section and such that release of heat from the condensation section to the fluid to be heated causes the vapor to condense to liquid in the condensation section;

the at least one conduit forming a loop extending from the evaporation section through the condensation section and back to the evaporation section so as to conduct the heat transfer fluid medium from the evaporation section to the condensation section and back to the evaporation section;

applying heat energy to the heat transfer medium by the heat source at the vaporizer section;

the conduit and condensation section having a resistance to flow of the vapor from the vaporizer section to and through the condensation section;

providing a trap having a trap leg defining a column of liquid in the conduit at a position adjacent to or at the evaporation section;

and arranging the trap leg such that, subsequent to start-up and during steady state flow of the heat transfer fluid medium in the loop, the column of liquid in the trap leg is caused to reach a height which defines a pressure in the liquid at least equal to a pressure drop in the vapor caused by the resistance to flow of the vapor in the conduit from the evaporation section to and through the condensation section;

wherein the system is at least partly evacuated prior to start up such that during steady state operation the pressure in the system is less than 15 psi above atmospheric pressure.

20. A method of heating petroleum products drawn from a well head comprising:

locating the petroleum products within a storage tank;

providing a heat source outside the storage tank;

providing at least one elongate conduit within the storage tank in the form of a loop extending from an inlet across the tank and returning to an outlet;

and transferring heat from the heat source to the petroleum products in the tank;

wherein the heat is transferred by a method comprising:

providing a closed system including at least one conduit;

providing an evaporation section of the closed system at the heat source;

providing a condensation section of the closed system in the fluid to be heated;

providing a heat transfer fluid medium within the closed system having a temperature of boiling from liquid to vapor such that heat from the heat source causes the liquid to boil to form a vapor in the evaporation section and such that release of heat from the condensation section to the fluid to be heated causes the vapor to condense to liquid in the condensation section;

the at least one conduit forming a loop extending from the evaporation section through the condensation section and back to the evaporation section so as to conduct the heat transfer fluid medium from the evaporation section to the condensation section and back to the evaporation section;

applying heat energy to the heat transfer medium by the heat source at the vaporizer section;

the conduit and condensation section having a resistance to flow of the vapor from the vaporizer section to and through the condensation section;

providing a trap having a trap leg defining a column of liquid in the conduit at a position adjacent to or at the evaporation section;

and arranging the trap leg such that, subsequent to start-up and during steady state flow of the heat transfer fluid medium in the loop, the column of liquid in the trap leg is caused to reach a height which defines a pressure in the liquid at least equal to a pressure drop in the vapor caused by the resistance to flow of the vapor in the conduit from the evaporation section to and through the condensation section to cause the flow in the conduit.

21. The method according to claim 20 wherein there is provided a plurality of conduits in the tank each connected to an inlet manifold and to an outlet manifold.

22. The method according to claim 20 wherein there is provided a temperature sensor for acting with a control unit as a thermostat at a predetermined set temperature of the petroleum products and wherein there is provided a safety over limit detector responsive to an over pressure or over temperature in the conduit and which is arranged to modulate or cycle the energy supplied to the evaporation section during a start up phase below the set temperature to maintain heating of the petroleum products while the petroleum products is resistant to absorbing heat.

* * * * *